US005623775A

United States Patent [19]

Farrington et al.

[11] Patent Number: 5,623,775

[45] Date of Patent: Apr. 29, 1997

[54] ELECTRIC STEAM IRON WITH IMPROVED WATER TANK AND SKIRT ASSEMBLY

[75] Inventors: Richard I. Farrington, Seymour; George M. Drizos, Cheshire, both of Conn.

[73] Assignee: Black & Decker Inc., Newark, Del.

[21] Appl. No.: 587,313

[22] Filed: Jan. 16, 1996

[51] Int. Cl.[6] ..... D06F 75/36

[52] U.S. Cl. ..... 38/88

[58] Field of Search ..... 78/77.2, 77.4, 78/77.1, 77.5, 77.7, 77.3, 77.8, 77.82, 77.83; 29/283.5; 24/458, 464, 527

[56] References Cited

U.S. PATENT DOCUMENTS

| | | | |
|---|---|---|---|
| 1,395,355 | 11/1921 | Peth | 38/77.1 |
| 2,475,571 | 7/1949 | Schreyer | 38/77.4 |
| 3,292,283 | 12/1966 | Hanner | 38/77.2 |
| 3,820,259 | 6/1974 | Flowers | 38/77.5 |
| 3,949,499 | 4/1976 | Schaeffer et al. | 38/77.3 |
| 4,640,028 | 2/1987 | Nakada et al. | 38/77.7 |
| 4,669,207 | 6/1987 | Hennuy et al. | 38/77.8 X |
| 4,748,755 | 6/1988 | Bain, Jr. et al. | 38/82 X |
| 5,367,799 | 11/1994 | Wilson et al. | 38/77.83 X |

FOREIGN PATENT DOCUMENTS

| | | | |
|---|---|---|---|
| 402256 | 12/1990 | European Pat. Off. | 38/88 |
| 47000 | 3/1984 | Japan | 38/77.8 |
| 197806 | 12/1976 | Netherlands | 38/77.8 |

*Primary Examiner*—Ismael Izaguirre
*Attorney, Agent, or Firm*—Barry E. Deutsch

[57] ABSTRACT

A water tank is connected to a skirt with a snap-lock connection and a single fastener. The tank has two spaced projections at its rear end that are snapped over a portion of the skirt. A front end of the tank has a rib with a notch that guides the front of the tank onto the skirt. The single fastener connects the front of the tank to the skirt. A steam valve is placed on the steam chamber, through a hole in the skirt, before the water tank is connected to the steam valve.

6 Claims, 3 Drawing Sheets

ELECTRIC STEAM IRON WITH IMPROVED WATER TANK AND SKIRT ASSEMBLY

BACKGROUND OF THE INVENTION

1. Field of the Invention

The present invention relates to electric steam irons and, more particularly, to assembly of a water tank to a skirt.

2. Prior Art

U.S. Pat. No. 3,292,283 discloses a steam valve in an iron having a bushing that is connected to a steam chamber cover plate. U.S. Pat. No. 4,640,028 discloses a nozzle from a water tank to a steam chamber that extends through a lid to the steam chamber. Two screws are used to connect the skirt to the soleplate and two screws are used to connect the body with the cover to form the water tank. Other types of water tank assemblies are shown in U.S. Pat. Nos. 1,395,355; 2,475,571; and 3,820,259.

SUMMARY OF THE INVENTION

In accordance with one embodiment of the present invention a method of assembling an electric steam iron is provided comprising steps of placing a steam valve through a hole in a skirt onto a steam chamber; and connecting a tank to the skirt after the steam valve is placed on the steam chamber, the tank having a nozzle that is inserted into the steam valve.

In accordance with another embodiment of the present invention in an electric steam iron having a soleplate, a skirt connected to the soleplate, and a water tank connected to the skirt, the improvement comprises the water tank having a rear end snap-lock mounted to the skirt and a front end with a guide that guides the tank onto the skirt during snap-lock mounting of the rear end to the skirt.

In accordance with another embodiment of the present invention, in an electric steam iron having a soleplate, a skirt connected to the soleplate, and a water tank connected to the skirt, the improvement comprises connection of the water tank to the skirt having a snap-lock connection of a first portion of the tank to the skirt, and a single fastener. The single fastener connects a second portion of the tank to the skirt.

In accordance with another embodiment of the present invention, in an electric steam iron having a soleplate, a skirt connected to the soleplate, and a water tank connected to the skirt, the improvement comprises connection of the skirt to the soleplate having two tabs on the soleplate that are passed through two holes in the skirt and then deformed to lock the skirt to the soleplate at the tabs. The connection also has a single first fastener. The first fastener is located at a front of the skirt and connects the front of the skirt to the soleplate.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
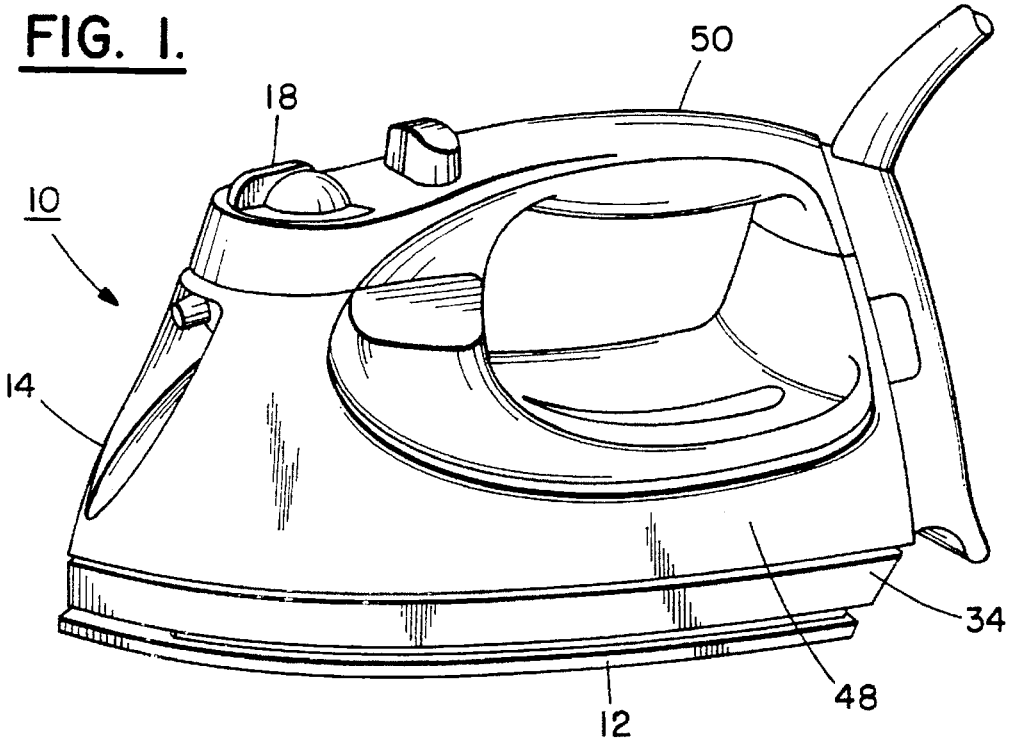
FIG. 1 is a perspective view of an iron incorporating features of the present invention.

Referring to FIG. 1, there is shown a perspective view of an electric steam iron 10 incorporating features of the present invention. Although the present invention will be described with reference to the single embodiment shown in the drawings, it should be understood that features of the present invention can be embodied in many alternative forms of alternate embodiments. The various alternative embodiments may also have any suitable size, shape or type of elements or materials.

Figure 1A:
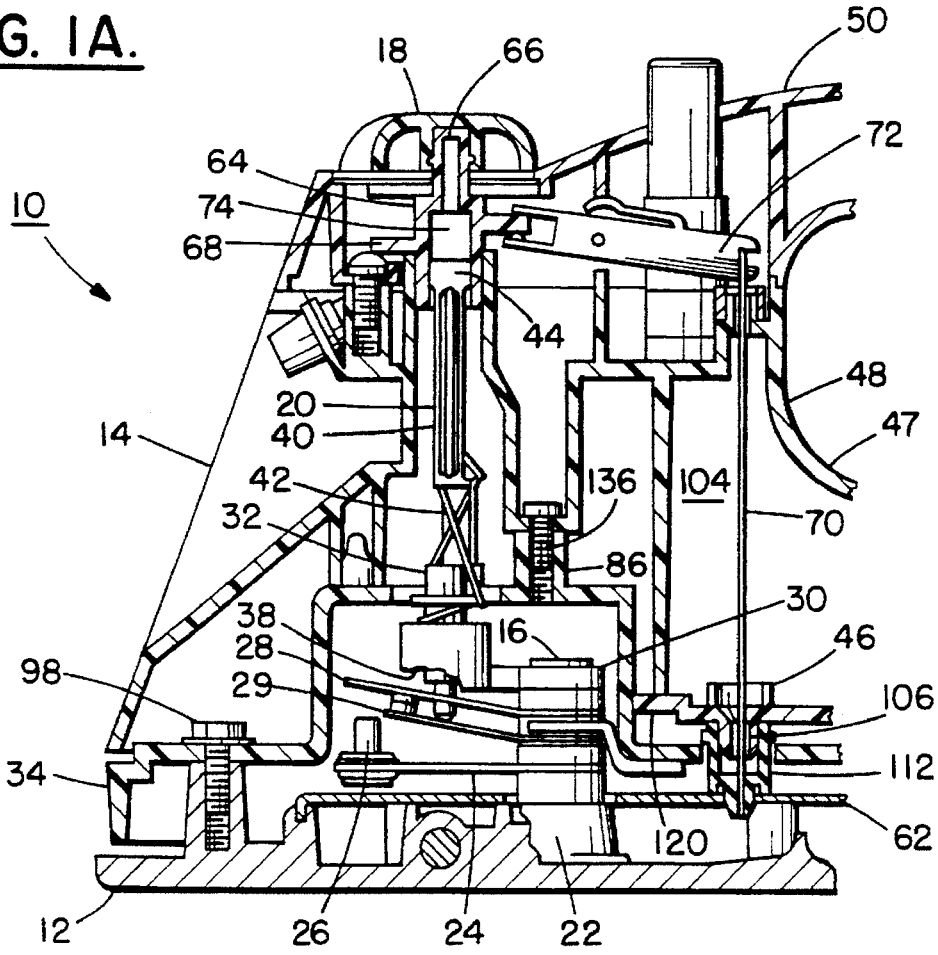
FIG. 1A is a partial schematic cross-sectional view of the front of iron shown in FIG. 1.

Referring also to FIG. 1A, the iron 10 generally comprises a soleplate 12, a housing 14, a thermostat 16, a temperature control knob 18, and an adapter shaft and spring assembly 20. The thermostat 16 is mounted to a boss 22 of the soleplate 12. The thermostat 16 is a flat stacked thermostat with a bi-metal blade 24, an insulated post 26, two electrical contact blades 28, 29, a frame 30, a shaft 32, and a cam member (not shown). The temperature control knob 18 is connected to the top end 44 of the adapter 40 by a steam valve cam member 64. The knob 18 is snap lock mounted to a top post 66 of the cam member 64. A cam rib 68 is connected to a steam valve stem 70 by a rocker 72. The cam member 64 has an aperture in its bottom forming an interior channel 74. The top end 44 of the adapter 40 is longitudinally slidably located in the channel 74. However, the top end 44 is rotationally interlocked with the member 64 such that when the member 64 is axially rotated, the adapter 40 is also axially rotated. In alternate embodiments other types of thermostats, thermostat contols and steam valve controls could be used. The housing 14 includes a temperature insulating skirt 34, a water tank bottom 46, a housing piece 48 that also forms a top of the water tank, and a top housing piece 50 that forms a handle 52 for the iron 10.

Figure 1B:
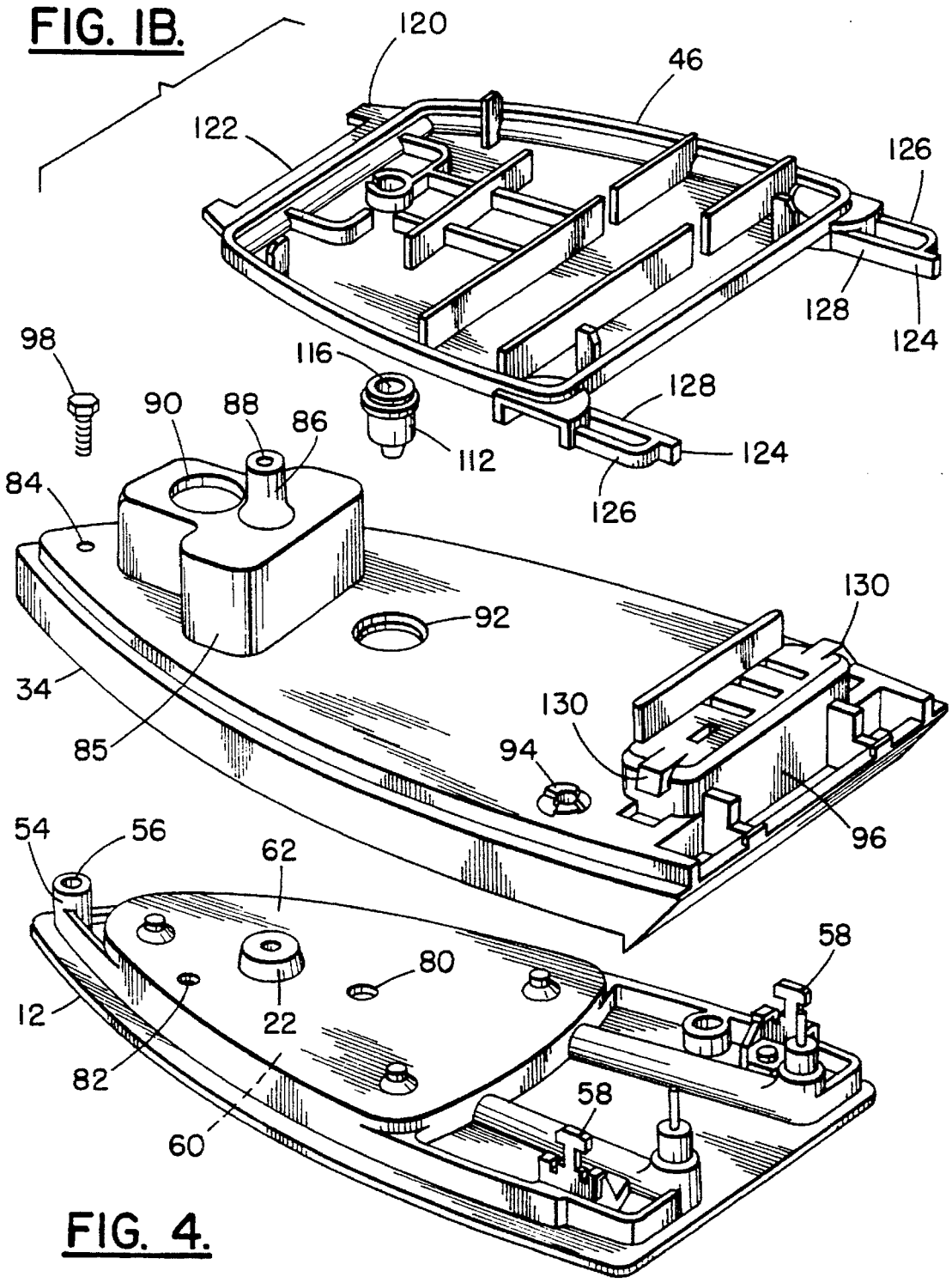
FIG. 1B is an exploded perspective view of portions of the iron shown in FIG. 1.

Referring also to FIG. 1B, the soleplate 12 has a boss 54 at its front with a hole 56. Located at the rear of the soleplate 12 are two fasteners 58. The fasteners are riveted to the soleplate 12. The soleplate 12 has a steam chamber 60. A metal cover 62 is attached to the soleplate 12 to form the steam chamber 60. The cover 62 has a main water entry hole 80 and a surge steam water entry hole 82. The skirt 34 has a front screw hole 84, a thermostat housing section 85, a mounting boss 86 with a hole 88, a hole 90 to allow for connection of the adapter assembly 20 to the thermostat 16, a steam valve hole 92, two rear mounting areas 94 (only one of which is shown), and a raised terminal connection stand 96.

Figure 2:
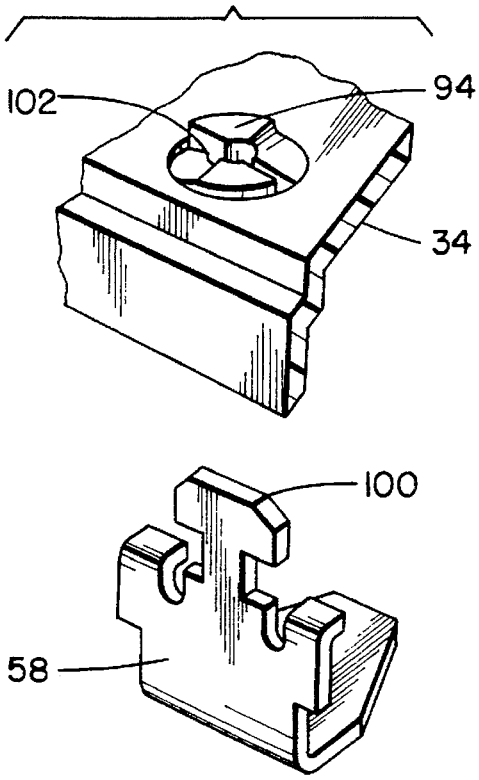
FIG. 2 is an exploded partial view of a portion of the skirt and one of the rear fasteners for the soleplate.
Figure 3:
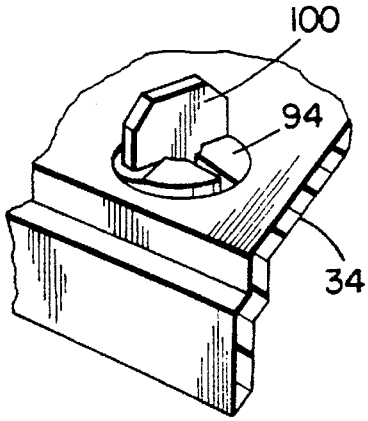
FIG. 3 is a partial perspective view of the skirt and fastener of FIG. 2 shown connected to each other.

Referring also to FIGS. 2 and 3, the skirt 34 is fixedly attached to the soleplate 12 by the two rear fasteners 58 and a front screw 98. When the skirt 34 is placed on the soleplate 12 the top "T" shaped sections 100 of the rear fasteners 58 extend up through slots 102 in the rear mounting areas 94. The top sections 100 are then twisted or bent, as seen in FIG. 3, to mount the skirt to the soleplate at the rear of the skirt and soleplate. The front screw 98 is attached to the front boss 54, through the hole 84, to attach the front of the skirt 34 to the front of the soleplate 12.

Figure 4:
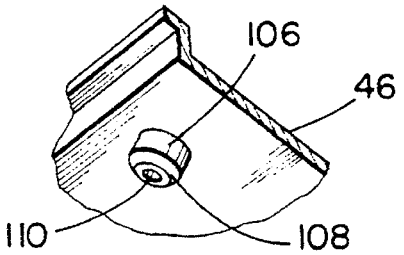
FIG. 4 is a partial perspective view of the front bottom of the tank bottom shown in FIG. 1A.
Figure 5:
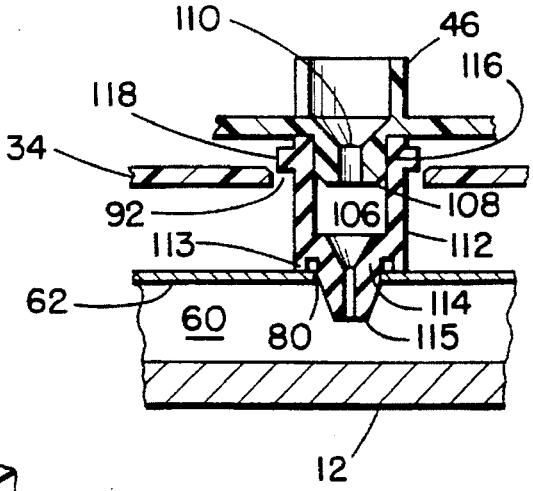
FIG. 5 is an enlarged cross-sectional view of the steam valve shown in FIG. 1A.

The water tank bottom 46 is attached to the housing piece 48, such as by ultrasonic welding or heat welding, to form the reservoir 104 (see FIG. 1A). The assembled two pieces 46, 48 are collectively referred to below as the tank 47. The bottom of the tank bottom 46 has a nozzle 106 as seen in FIG. 4. The nozzle 106 has a chamfer 108 at its leading edge and a hole 110. As seen in FIG. 1A, the valve stem 70 extends through the reservoir 104 and through the hole 110 into the steam valve 112. The steam valve 112 is made of a resilient polymer or silicon material. Referring also to FIG. 5, the steam valve 112 has a bottom section 114 with a rim 113 that rests against the top surface of the steam chamber cover 62 and a portion 115 that projects into the main water entry hole 80. The top of the steam valve 112 has an aperture 116 and a flange 118. The nozzle 106 is positioned into the aperture 116. The flange 118 substantially blocks the hole 92 in the skirt 34 to reduce heat passage through the hole 92.

Figure 6:
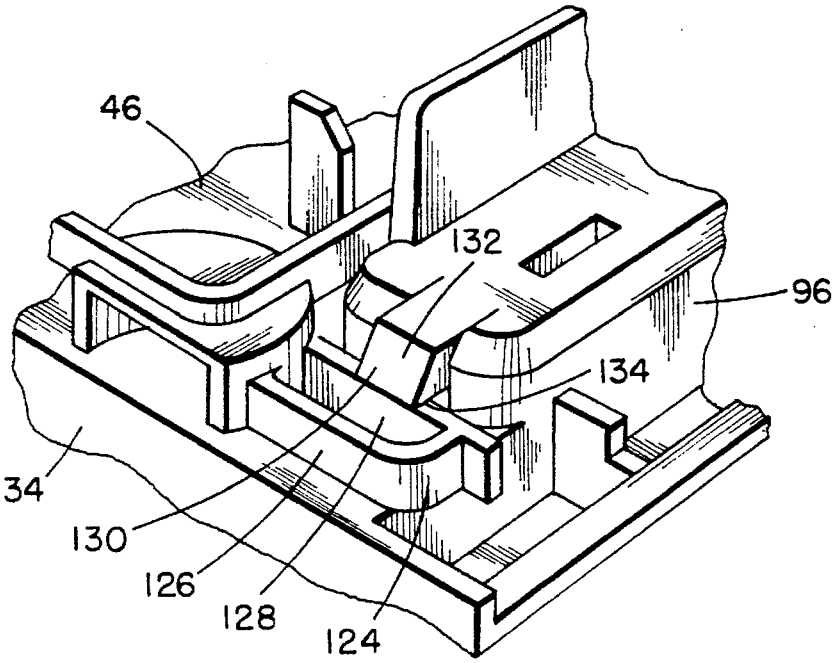
FIG. 6 is a partial rear, side and top perspective view showing one of the rear connections of the tank to the skirt.

Referring to FIG. 1B, the front end of the water tank bottom 46 has a forward extending rib 120 with a notch 122. The notch 122 is suitably sized and shaped to receive the rear end of the thermostat housing section 85 therein. The rear end of the tank bottom 46 has two spaced apart deflectable projections 124. Referring also to FIG. 6, the projections 124 each comprise two sections 126, 128 that extend rearwardly. The terminal connection stand 96 of the skirt 34 is located between the two projections 124. The terminal connection stand 96 has two snap-lock ledges 130 located on opposite sides of the stand. Each snap-lock ledge 130 has a top wedging surface 132 and a bottom surface 134. The tank bottom 46 is attached to the housing piece 48, as mentioned above, and then the tank 47, is attached to the skirt 34. To attach the tank 47 to the skirt 34, the front rib 120 is positioned against the rear of the thermostat housing section 85. The section 85 is received in the notch 122 such that the rib 120 can locate the front of the tank 47 into a proper location on the skirt 34. The two rear projections 124 are then located at the top wedging surfaces 132 of the snap-lock ledges 130. The rear of the tank 47 is then pushed towards the skirt 34. The projections 124 are wedged outward by the wedging surfaces 132 and then snap back under the bottom surfaces 134 when the projections 124 pass the ledges 130. Referring also to FIG. 1A, the final step in attaching the tank 47 to the skirt 34 comprises attaching a single fastener 136 at the mounting boss 86 to fixedly attached the housing piece 48 to the skirt 34.

Before the tank 47 is attached to the skirt 34, the skirt is attached to the soleplate 12 as described above. The steam valve 112 is preferably attached to the steam chamber cover 62 before the steam valve 112 is attached to the nozzle 106. More specifically, referring to FIGS. 1B, 4 and 5, after the skirt 34 is attached to the soleplate 12, the steam valve 112 is passed into the hole 92 in the skirt 34. The rim 113 of the valve 112 is located on top of the cover 62. The portion 115 extends into the main water entry hole 80. After the steam valve 112 is located on the steam chamber cover 62, the tank 47 is then connected to the skirt 34. As the tank 47 is being connected to the skirt 34, the nozzle 106 is inserted into the top aperture 116 of the steam valve 112. More specifically, when the rib 120 on the water tank bottom 46 is lowered into position at the bottom rear of the thermostat housing section 85, interaction between the rib 120 and the section 85 properly locate the nozzle 106 over the aperture 116. Further movement of the tank 47 downward inserts the nozzle 106 into the aperture 116. The chamfer 108 at the leading edge of the nozzle 106 helps to guide the nozzle into the aperture. With this type of assembly method, the valve 112 is not significantly distorted by relative movement of the tank relative to the soleplate because the tank is merely vertically moved, or dropped down, onto the valve 112. This type of top-down assembly makes assembly easier, less expensive and more reliable for quality control purposes. When the fastener 136 is tightened, the front of the tank 47 is pulled down against the skirt 34. This causes the steam valve 112 to be compressed between the steam chamber cover 62 and the tank 47 to form a good seal. The flange 118 expands slightly to further block the hole 92.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electric steam iron having a soleplate, a skirt connected to the soleplate, and a water tank connected to the skirt, further including:

a pair of deflectable arms mounted in spaced parallel relation on a bottom wall of said water tank; and a pair of ledges mounted on a top surface of the skirt in vertical alignment with the deflectable arms, said ledges deflecting said arms when the tank is placed on said skirt, said arms being snap-locked to said ledges for retaining said tank on said skirt.

2. An electric steam iron in accordance with claim 1 wherein said tank further includes a rib mounted at the front end thereof, said rib including a notch, said skirt further including a guide in vertical alignment with said notch to position said tank onto said skirt.

3. An electric steam iron in accordance with claim 2 further comprising a pair of spaced tabs on the soleplate and a pair of holes in the skirt in vertical alignment with said tabs, said tabs being passed through said holes and then deformed to lock the skirt to the soleplate.

4. An electric steam iron in accordance with claim 3 wherein the upper surface of the skirt includes a laterally extending block, said block including said ledges and said holes.

5. An electric steam iron in accordance with claim 1 further comprising a pair of spaced tabs on the soleplate and a pair of holes in the skirt in vertical alignment with said tabs, said tabs being passed through said holes and then deformed to lock the skirt to the soleplate.

6. An electric steam iron in accordance with claim 5 wherein the upper surface of the skirt includes a laterally extending block, said block including said ledges and said holes.

* * * * *